US010486852B2

(12) United States Patent
Gogola et al.

(10) Patent No.: US 10,486,852 B2
(45) Date of Patent: Nov. 26, 2019

(54) CAN END PRODUCED FROM DOWNGAUGED BLANK

(71) Applicant: Rexam Beverage Can Company, Broomfield, CO (US)

(72) Inventors: Michael R. Gogola, Itasca, IL (US); Randall G. Forrest, Park Ridge, IL (US)

(73) Assignee: REXAM BEVERAGE CAN COMPANY, Broomfield, CO (US)

( * ) Notice: Subject to any disclaimer, the term of this patent is extended or adjusted under 35 U.S.C. 154(b) by 161 days.

(21) Appl. No.: 15/417,830

(22) Filed: Jan. 27, 2017

(65) Prior Publication Data

US 2017/0137169 A1 May 18, 2017

Related U.S. Application Data

(62) Division of application No. 12/795,434, filed on Jun. 7, 2010, now Pat. No. 9,566,634.

(51) Int. Cl.
*B65D 17/40* (2006.01)
*B65D 17/28* (2006.01)
(Continued)

(52) U.S. Cl.
CPC ..... *B65D 17/4012* (2018.01); *B21D 22/24* (2013.01); *B21D 51/383* (2013.01);
(Continued)

(58) Field of Classification Search
CPC ..... B65D 17/4012; B65D 2517/0062; B65D 2517/0014; B21D 51/383; B21D 22/24; B21D 51/44
(Continued)

(56) References Cited

U.S. PATENT DOCUMENTS 3,537,291 A 11/1970 Hawkins
3,774,801 A 11/1973 Gedde
(Continued)

FOREIGN PATENT DOCUMENTS

EP 0103074 A2 3/1984
EP 0149185 A2 7/1985
(Continued)

OTHER PUBLICATIONS

The Federal Institute of Industrial Property, Inquiry under the Substantive Examination of Russian Application No. 2012155151/12, dated Jun. 5, 2015, Moscow, Russia (translation provided).
(Continued)

*Primary Examiner* — James N Smalley
(74) *Attorney, Agent, or Firm* — Greer, Burns & Crain, Ltd.

(57) ABSTRACT

A can end for a two-piece beverage container has a curl positioned about a longitudinal axis which defines an outer perimeter of the can end. A circumferential wall angles downwardly and radially inwardly relative to a radially inner portion of the curl. A strengthening member extends radially inwardly relative to the circumferential wall. A center panel extends radially outwardly from the longitudinal axis towards the strengthening member and has a diameter greater than 87.7% of an overall diameter of the can end. A frangible score and a hinge portion define an openable tear panel in the center panel. A stay-on tab is attached to the center panel and has a nose portion overlying the tear panel opposite a lift end of the tab.

19 Claims, 8 Drawing Sheets

(51) Int. Cl.
*B21D 51/44* (2006.01)
*B21D 22/24* (2006.01)
*B21D 51/38* (2006.01)

(52) U.S. Cl.
CPC ..... *B21D 51/44* (2013.01); *B65D 2517/0014* (2013.01); *B65D 2517/0062* (2013.01)

(58) Field of Classification Search
USPC ..... 220/269
See application file for complete search history.

(56) References Cited

U.S. PATENT DOCUMENTS 3,843,014 A 10/1974 Cospen et al.
4,031,837 A 6/1977 Jordan
4,084,721 A 4/1978 Perry
4,093,102 A 6/1978 Kraska
4,109,599 A 8/1978 Schultz
4,217,843 A 8/1980 Kraska
4,372,720 A 2/1983 Herdzina et al.
4,434,641 A 3/1984 Nguyen
4,448,322 A 5/1984 Kraska
4,467,933 A 8/1984 Wilkinson et al.
4,559,801 A 12/1985 Smith et al.
4,561,280 A 12/1985 Bachmann et al.
4,567,746 A 2/1986 Bachmann et al.
4,571,978 A 2/1986 Taube et al.
4,577,774 A 3/1986 Nguyen
4,587,825 A 5/1986 Bulso, Jr. et al.
4,606,472 A 8/1986 Taube et al.
4,641,761 A 2/1987 Smith et al.
4,648,528 A 3/1987 LaBarge et al.
4,685,849 A 8/1987 LaBarge et al.
4,704,887 A 11/1987 Bachmann et al.
4,713,958 A 12/1987 Bulso, Jr. et al.
4,716,755 A 1/1988 Bulso, Jr. et al.
4,722,215 A 2/1988 Taube et al.
4,735,863 A 4/1988 Bachmann et al.
4,790,705 A 12/1988 Wilkinson et al.
4,796,772 A 1/1989 Nguyen
4,808,052 A 2/1989 Bulso, Jr. et al.
4,809,861 A 3/1989 Wilkinson et al.
4,832,223 A 5/1989 Kalenak et al.
4,862,722 A 9/1989 Fraze et al.
4,865,506 A 9/1989 Kaminski
RE33,217 E 5/1990 Nguyen
4,928,844 A 5/1990 LaBarge
4,977,772 A 12/1990 Bulso, Jr. et al.
4,991,735 A 2/1991 Biondich
5,046,637 A 9/1991 Kysh
5,062,287 A 11/1991 Brown et al.
5,149,238 A 9/1992 McEldowney et al.
5,331,836 A 7/1994 Cudzik
5,356,256 A * 10/1994 Turner ..... B21D 51/383 413/8
5,502,995 A 4/1996 Stodd
5,527,143 A 6/1996 Turner et al.
5,590,807 A * 1/1997 Forrest ..... B21D 51/383 220/608
5,685,189 A * 11/1997 Nguyen ..... B21D 51/38 413/8
5,987,956 A 11/1999 Strube et al.
6,024,239 A 2/2000 Turner et al.
6,065,634 A 5/2000 Brifcani et al.
6,126,034 A 10/2000 Borden et al.
6,234,336 B1 5/2001 Neiner
6,419,110 B1 7/2002 Stodd
6,460,723 B2 10/2002 Nguyen et al.
6,499,622 B1 12/2002 Neiner
6,516,968 B2 2/2003 Stodd
6,561,004 B1 * 5/2003 Neiner ..... B21D 51/32 413/2
6,736,283 B1 5/2004 Santamaria et al.
6,748,789 B2 6/2004 Turner et al.
7,341,163 B2 3/2008 Stodd
7,370,774 B2 5/2008 Watson et al.
7,591,392 B2 9/2009 Watson et al.
9,821,928 B2 * 11/2017 Forrest ..... B65D 17/4012
2002/0190071 A1 * 12/2002 Neiner ..... B21D 51/32 220/619
2003/0010785 A1 1/2003 Stodd
2003/0121920 A1 7/2003 Zonker et al.
2003/0121924 A1 7/2003 Stodd
2004/0074911 A1 4/2004 Stodd
2005/0006395 A1 * 1/2005 Reed ..... B21D 51/32 220/619
2005/0029269 A1 * 2/2005 Stodd ..... B21D 51/32 220/619
2005/0252917 A1 * 11/2005 Turner ..... B65D 17/28 220/269
2007/0029324 A1 2/2007 Watson et al.
2010/0044383 A1 2/2010 Watson et al.

FOREIGN PATENT DOCUMENTS

EP 0149823 A2 7/1985
EP 0153115 A2 8/1985
EP 0497346 A1 8/1992
EP 0497346 B1 9/1996
EP 0828663 B1 12/1999
EP 1306310 A2 5/2003
GB 2067159 A 7/1981
GB 1604068 12/1981
GB 2193140 A 2/1988
RU 2278062 C2 3/2005
RU 2344056 C2 6/2008
RU 2361693 C1 7/2009
WO 199637414 A1 11/1996
WO 199834743 A1 8/1998
WO 199901351 A2 1/1999
WO 200141948 A2 6/2001
WO 2003053800 A1 7/2003
WO 2005113352 A1 12/2005
WO 2007005564 A2 1/2007

OTHER PUBLICATIONS

Rexam Beverage Can Company, International Search Report from International Application No. PCT/US2011/039459 dated Oct. 26, 2011 by the European Patent Office, acting as the International Searching Authority.

* cited by examiner

CAN END PRODUCED FROM DOWNGAUGED BLANK

CROSS-REFERENCE TO RELATED APPLICATIONS

This is a divisional patent application of patent application Ser. No. 12/795,434, which was filed on Jun. 7, 2010 and is now U.S. Pat. No. 9,566,634 B2, which was issued on Feb. 14, 2017, the entire content of which is hereby incorporated by reference.

FEDERALLY SPONSORED RESEARCH OR DEVELOPMENT

N/A

TECHNICAL FIELD

The invention relates to beverage containers; more particularly, the present invention relates to can ends or lids for two-piece metallic beverage cans produced from a reduced volume of metal, notably a blank of a reduced thickness.

BACKGROUND OF THE INVENTION

Common end closures for beer and beverage containers have a central panel that has a frangible panel (sometimes called a "tear panel," "opening panel," or "pour panel") defined by a score formed on the outer surface, the "consumer side," of the end closure. Popular "ecology" can ends are designed to provide a way of opening the end by fracturing the scored metal of the panel, while not allowing separation of any parts of the end. For example, the most common such beverage container end has a tear panel that is retained to the end by a non-scored hinge region joining the tear panel to the reminder of the end, with a rivet to attach a leverage tab provided for opening the tear panel. This type of container end, typically called a "stay-on-tab" ("SOT") end has a tear panel that is defined by an incomplete circular-shaped score, with the non-scored segment serving as the retaining fragment of metal at the hinge-line of the displacement of the tear panel.

The container is typically a drawn and ironed metal can, usually constructed from a thin plate of aluminum. End closures for such containers are also typically constructed from a cut-edge of thin plate of aluminum or steel, formed into a blank end, and manufactured into a finished end by a process often referred to as end conversion. These ends are formed in the process of first forming a cut-edge of thin metal, forming a blank end from the cut-edge, and converting the blank into an end closure which may be seamed onto a container. Although not presently a popular alternative, such containers and/or ends may be constructed of plastic material, with similar construction of non-detachable parts provided for openability.

These types of "stay-on-tab" ecology container ends have been used for many years, with a retained tab and a tear panel of various different shapes and sizes. Throughout the use of such ends, manufacturers have sought to save the expense of the metal by down-gauging the metal of the ends and the tabs. However, because ends are used for containers with pressurized contents and are sometimes subject to pasteurization, there are conditions causing great stresses to the components of the end during pasteurization, transit and during opening by a user. These conditions limit the available gauge reduction of the end metal, and make it difficult to alter design characteristics of the end, such as by reducing metal gauge or the thickness of the metal residual in the score defining the tear panel.

The pressurized contents of the container often cause risk for the end to buckle. The pressurized contents may also result in a condition in which the tab is forced upwardly. There is a maximum allowable distance that the tab can be displaced without the tab extending upwardly above the remainder of the container. This is called tab-over-chime. Tab-over-chime leads to ship abuse problems wherein the frangible panel prematurely fractures during distribution of filled beverage containers.

As manufacturers reduce the thickness of the metal used to make the ends, buckle and tab-over-chime become more and more of a problem. Therefore, a need for can end with improved ability to withstand buckle and tab-over-chime is needed.

Finished can ends, also referred to as reformed or converted can ends, are available in many sizes. The different sizes are generally identified as 200, 202, 206, and 209. The sizes are distinguished, in part, by their respective diameters. The 200 can end is the smallest, and the 209 is the largest. The diameter of the 209 can end is typically at least 60 mm, more likely about 70 mm or slightly less than 70 mm, about 65 mm when seamed to a can body.

The present invention is provided to solve the problems discussed above and other problems, and to provide advantages and aspects not provided by prior can ends or lids of this type. A full discussion of the features and advantages of the present invention is deferred to the following detailed description, which proceeds with reference to the accompanying drawings.

SUMMARY

A first aspect of the present invention is directed to a can end for a two-piece beverage container. The can end comprises: a curl positioned about a longitudinal axis and defining an outer perimeter of the can end; a circumferential wall angled downwardly and radially inwardly relative to a radially inner portion of the curl; a strengthening member extending radially inwardly relative to the circumferential wall; a center panel extending radially outwardly from the longitudinal axis towards the strengthening member having a diameter greater than 87.7% of the overall diameter of the can end; a frangible score and a hinge portion defining an openable tear panel in the center panel; and a stay-on tab attached to the center panel having a nose portion overlying the tear panel opposite a lift end of the tab.

The first aspect of the invention may include one or more of the following features, alone or in any reasonable, non-conflicting combination. The strengthening member may be a generally U-shaped countersink having an inner wall joined to an outer wall by an annular curved portion wherein the inner wall is substantially vertical. A bend may be located between the circumferential wall and the outer wall of the countersink wherein the bend directs the circumferential wall upwardly and outwardly relative to the longitudinal axis. The annular curved segment of the countersink may have been reformed to decrease the radius of curvature thereof. The circumferential wall and the outer wall of the countersink may have been reformed to increase a height of the bend above a lowermost portion of the countersink. A depth of the countersink as measured from an uppermost portion of the curl to a lowermost portion of the countersink may have been decreased in a reforming operation. A radius of curvature of the panel radius may have been decreased during a reforming operation. An angle of the circumferential wall may have been increased during a reforming operation. The diameter of the outer perimeter of the can end shell is held substantially constant during reforming. A thickness of the center panel of the can end may be about 0.287 mm. A height of the center panel may be about 2.06 mm. A radius of curvature of an annular curved segment of the countersink may be about 0.38 mm.

A second aspect of the present invention is directed to a can end for a two-piece beverage container. The can end comprises: a curl positioned about a longitudinal axis and defining an outer perimeter of the can end having a diameter greater than 63 mm; a circumferential wall angled downwardly and radially inwardly relative to a radially inner portion the curl; a generally U-shaped countersink extending downwardly and radially inwardly relative to the circumferential wall; a bend joining the circumferential wall with the countersink having a center of curvature located below a product side of the can end; a center panel extending radially outwardly from the longitudinal axis towards the strengthening member having a diameter greater than 87.7% of the overall diameter of the can end; a panel radius joining the center panel with the countersink having an uppermost portion having a height as measured from a lowermost portion of the can end greater than a height of the bend; a frangible score and a hinge portion defining an openable tear panel in the center panel; and a stay-on tab attached to the center panel having a nose portion overlying the tear panel opposite a lift end of the tab.

A third aspect of the present invention is directed to a can end for a two-piece beverage container. The can end comprises: a center panel extending radially outwardly from a longitudinal axis having a reformed panel radius along an outer peripheral edge wherein the center panel has an expanded diameter subsequent to a reforming operation; a frangible score and a hinge portion defining an openable tear panel in the center panel; a stay-on tab attached to the center panel having a nose portion overlying the tear panel opposite a lift end of the tab; a wall extending downwardly relative to the panel radius to an annular bead extending radially outwardly relative to the reformed wall; an outer wall extending upwardly relative to the annular bead to a bend having a center of curvature below a product side of the can end; a circumferential wall angled upwardly relative to the bend; and a curl positioned about a longitudinal axis and defining an outer perimeter of the can end.

A fourth aspect of the present invention is directed to a can end for a two-piece beverage container. The can end comprises: a center panel extending radially outwardly from a longitudinal axis having a panel radius along an outer peripheral edge; a frangible score and a hinge portion defining an openable tear panel in the center panel; a stay-on tab attached to the center panel having a nose portion overlying the tear panel opposite a lift end of the tab; a reformed wall extending downwardly relative to the panel radius to an annular bead extending radially outwardly relative to the reformed wall wherein the reformed wall has a more vertical orientation subsequent to a reforming operation forcing the reformed wall radially outwardly; an outer wall extending upwardly relative to the annular bead to a bend having a center of curvature below a product side of the can end; a circumferential wall angled upwardly from the bend; and a curl positioned about a longitudinal axis and defining an outer perimeter of the can end.

A fifth aspect of the present invention is directed to a can end for a two-piece beverage container, the can end comprising: a center panel extending radially outwardly from a longitudinal axis having a panel radius along an outer peripheral edge; a frangible score and a hinge portion defining an openable tear panel in the center panel; a stay-on tab attached to the center panel having a nose portion overlying the tear panel opposite a lift end of the tab; a wall extending downwardly from the panel radius to an annular bead extending radially outwardly relative to the wall; an outer wall extending upwardly relative to the annular bead to an elevated bend having a center of curvature below a product side of the can end wherein the elevated bend has an increased height above a lowermost portion of the annular bead subsequent to a reforming operation; a circumferential wall angled upwardly from the bend; and a curl positioned about a longitudinal axis and defining an outer perimeter of the can end.

A sixth aspect of the present invention is directed to a can end for a two-piece beverage container. The can end comprises: a center panel extending radially outwardly from a longitudinal axis having a panel radius along an outer peripheral edge; a coined segment of a compressed metal in the center panel having a portion of a minimum thickness wherein a rate at which a compressed metal thickness increases from the minimum thickness to a thickness of an uncoined center panel portion is less when moving radially outwardly from minimum thickness than when moving radially inwardly; a frangible score and a hinge portion defining an openable tear panel in the center panel; a stay-on tab attached to the center panel having a nose portion overlying the tear panel opposite a lift end of the tab; a strengthening member extending radially outwardly relative to the peripheral edge of the center panel; a circumferential wall angled upwardly relative to the bend; and a curl defining an outer perimeter of the can end.

A seventh aspect of the present invention is directed to a can end for a two-piece beverage container. The can end comprises: a curl positioned about a longitudinal axis and defining an outer perimeter of the can end wherein a diameter of the can end is at least 60 mm and less than about 65 mm; a circumferential wall angled downwardly and radially inwardly from the curl; a strengthening member extending radially inwardly from the circumferential wall; a center panel extending radially outwardly from the longitudinal axis towards the strengthening member having a diameter greater than 57 mm.

An eighth aspect of the present invention is directed to a method of forming a can end for a two-piece beverage container. The can end has a central panel wall with a product side and a public side, the public side having a means for opening a frangible panel segment. The method comprises the steps of: providing an end member shell comprising a central panel extending radially outwardly from a longitudinal axis, a panel radius along a peripheral edge of the central panel, a strengthening member integral with the panel radius, a circumferential wall extending upwardly from the strengthening member, and a curl defining the outer perimeter of the end member shell and integral with the circumferential wall; and reforming the end member shell to increase a diameter of the central panel wall.

The eighth aspect of the invention may include one or more of the following features, alone or in any reasonable, non-conflicting combination. The method may further comprise the step of reforming the end member shell to increase the height of the bend above the lowermost portion of the strengthening member. The method may further comprise the step of reforming the end member shell to decrease a radius of curvature of the panel radius. The method may further comprise the step of reforming the end member shell wherein an angle of the inner wall as measured from a vertical axis is reduced. The method may further comprise the step of reforming the end member shell to increase a height of the center panel relative to a lowermost portion of the strengthening member. The method may further comprise the step of reforming the end member shell to decrease a radius of curvature of an annular curved segment of the strengthening member. The method may further comprise the step of coining an outer peripheral edge of the center panel such to produce a segment of compressed metal having a portion of a minimum thickness wherein a rate at which a compressed metal thickness increases from the minimum thickness to a thickness of an uncoined center panel portion is less when moving radially outwardly from minimum thickness than when moving radially inwardly.

A ninth aspect of the present invention is directed to a method of forming a can end for a two-piece beverage container. The can end has a central panel wall with a product side and a public side, the public side having a means for opening a frangible panel segment. The method comprises the steps of: providing an end member shell comprising a central panel extending radially outwardly from a longitudinal axis, a panel radius along a peripheral edge of the central panel, a strengthening member integral with the panel radius, a circumferential wall extending upwardly from the strengthening member having a bend therein located at a height above a lowermost portion of the strengthening member, and a curl defining the outer perimeter of the end member shell and integral with the circumferential wall; and reforming the end member shell to increase the height of the bend above the lowermost portion of the strengthening member.

A tenth aspect of the present invention is directed to a method of forming a can end for a two-piece beverage container. The can end has a central panel wall with a product side and a public side, the public side having a means for opening a frangible panel segment. The method comprises the steps of: providing an end member shell comprising a central panel extending radially outwardly from a longitudinal axis, a panel radius along a peripheral edge of the central panel, a strengthening member integral with the panel radius, a circumferential wall extending upwardly from the strengthening member, and a curl defining the outer perimeter of the end member shell and integral with the circumferential wall; and reforming the end member shell to decrease a radius of curvature of the panel radius.

An eleventh aspect of the present invention is directed to a method of forming a can end for a two-piece beverage container. The can end has a central panel wall with a product side and a public side, the public side having a means for opening a frangible panel segment. The method comprises the steps of: providing an end member shell comprising a central panel extending radially outwardly from a longitudinal axis, a panel radius along a peripheral edge of the central panel, a countersink integral with the panel radius having an inner wall extending downwardly to an annular curved segment, a circumferential wall extending upwardly from the annular curved segment, and a curl defining the outer perimeter of the end member shell and integral with the circumferential wall; and reforming the end member shell wherein an angle of the inner wall as measured from a vertical axis is reduced.

A twelfth aspect of the present invention is directed to a method of forming a can end for a two-piece beverage container. The can end has a central panel wall with a product side and a public side, the public side having a means for opening a frangible panel segment. The method comprises the steps of: providing an end member shell comprising a central panel extending radially outwardly from a longitudinal axis, a panel radius along a peripheral edge of the central panel, a strengthening member integral with the panel radius, a circumferential wall extending upwardly from the strengthening member, and a curl defining the outer perimeter of the end member shell and integral with the circumferential wall; and reforming the end member shell to increase a height of the center panel relative to a lowermost portion of the strengthening member.

A thirteenth aspect of the present invention is directed to a method of forming a can end for a two-piece beverage container. The can end has a central panel wall with a product side and a public side, the public side having a means for opening a frangible panel segment. The method comprises the steps of: providing an end member shell comprising a central panel extending radially outwardly from a longitudinal axis, a panel radius along a peripheral edge of the central panel, a countersink integral with the panel radius having an inner wall extending downwardly to an annular curved segment, a circumferential wall extending upwardly from the annular curved segment, and a curl defining the outer perimeter of the end member shell and integral with the circumferential wall; and reforming the end member shell to decrease a radius of curvature of the annular curved segment.

A fourteenth aspect of the present invention is directed to a method of forming a can end for a two-piece beverage container. The can end has a central panel wall with a product side and a public side, the public side having a means for opening a frangible panel segment. The method comprises the steps of: providing an end member shell comprising a central panel extending radially outwardly from a longitudinal axis, a panel radius along a peripheral edge of the central panel, a countersink integral with the panel radius having an inner wall extending downwardly to an annular curved segment, a circumferential wall extending upwardly from the annular curved segment, and a curl defining the outer perimeter of the end member shell and integral with the circumferential wall; and reforming the end member shell to decrease a distance from an uppermost portion of a product side of the curl to a lowermost portion of the annular curved segment.

A fifteenth aspect of the present invention is directed to a method of forming a can end for a two-piece beverage container. The can end has a central panel wall with a product side and a public side, the public side having a means for opening a frangible panel segment. The method comprises the steps of: providing an end member shell comprising a central panel extending radially outwardly from a longitudinal axis, a panel radius along a peripheral edge of the central panel, a strengthening member integral with the panel radius, a circumferential wall extending upwardly from the strengthening member, and a curl defining the outer perimeter of the end member shell and integral with the circumferential wall; and coining an outer peripheral edge of the center panel such to produce a segment of compressed metal having a portion of a minimum thickness wherein a rate at which a compressed metal thickness increases from the minimum thickness to a thickness of an uncoined center panel portion is less when moving in one radial direction than when moving in an opposite radial direction. The method may further comprise the step of cold working the strengthening member and the panel radius during the reforming step.

A sixteenth aspect of the invention is directed to a can end for a two-piece beverage container. The can end comprises: a curl positioned about a longitudinal axis and defining an outer perimeter of the can end having a diameter at least about 50 mm and less than about 70 mm; a circumferential wall angled downwardly and radially inwardly relative to a radially inner portion the curl wherein an angle of the circumferential wall is greater than about 10°; a countersink extending downwardly and radially inwardly relative to the circumferential wall; a center panel extending radially outwardly from the longitudinal axis towards the countersink having a diameter greater than 87.7% of the overall diameter of the can end; a panel radius joining the center panel with the countersink; a frangible score and a hinge portion defining an openable tear panel in the center panel; and a stay-on tab attached to the center panel having a nose portion overlying the tear panel opposite a lift end of the tab.

The sixteenth aspect of the invention may include one or more of the following features, alone or in any reasonable, non-conflicting combination. The can end may further comprise a bend joining the circumferential wall with the countersink having a center of curvature located below a product side of the can end. An uppermost portion of the panel radius may have a height as measured from a lowermost portion of the can end greater than a height of the bend. The overall diameter may be greater than about 65 mm and the center panel may have a diameter greater than about 57 mm. The countersink may be generally U-shaped having an inner wall joined to an outer wall by an annular curved portion wherein the inner wall is substantially vertical. The can end may further comprise a coined segment of a compressed metal in the center panel having a portion of a minimum thickness wherein a rate at which a compressed metal thickness increases from the minimum thickness to a thickness of an uncoined center panel portion is less when moving radially outwardly from minimum thickness than when moving radially inwardly. A thickness of the center panel of the can end may be about 0.287 mm. A height of the center panel may be about 2.06 mm. A radius of curvature of an annular curved segment of the countersink may be about 0.38 mm.

A seventeenth aspect of the present invention is directed to a can end for a two-piece beverage container. The can end comprises: a curl positioned about a longitudinal axis and defining an outer perimeter of the can end; a circumferential wall angled downwardly and radially inwardly relative to a radially inner portion the curl; a countersink extending downwardly and radially inwardly relative to the circumferential wall having an outer wall joined to an inner wall by an annular curved segment; a center panel extending radially outwardly from the longitudinal axis towards the countersink; a panel radius joining the center panel with the countersink; a frangible score and a hinge portion defining an openable tear panel in the center panel; a stay-on tab attached to the center panel having a nose portion overlying the tear panel opposite a lift end of the tab; and wherein the inner wall of the countersink and the panel radius comprise a zone of reformed cold worked metal having increased strength.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
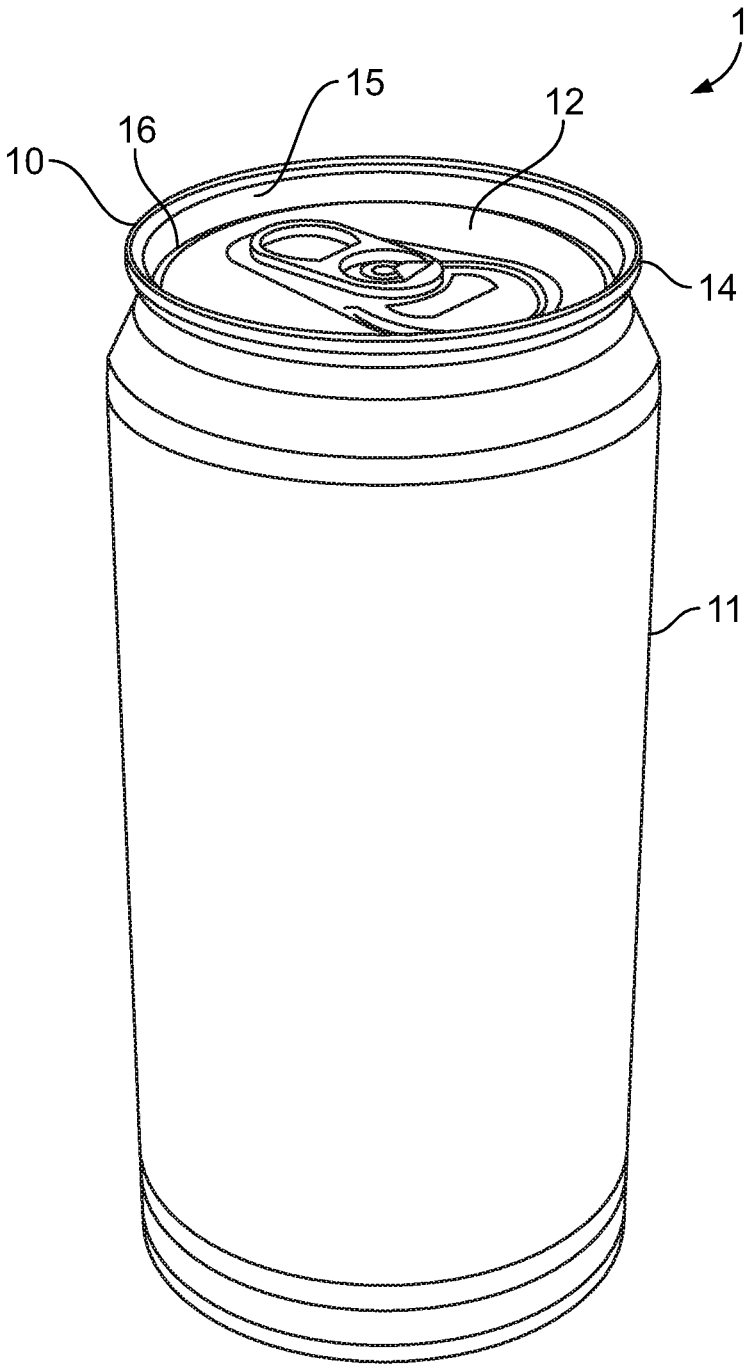
FIG. 1 is a perspective view of a container having a reformed can end or lid of the present invention.
Figure 2:
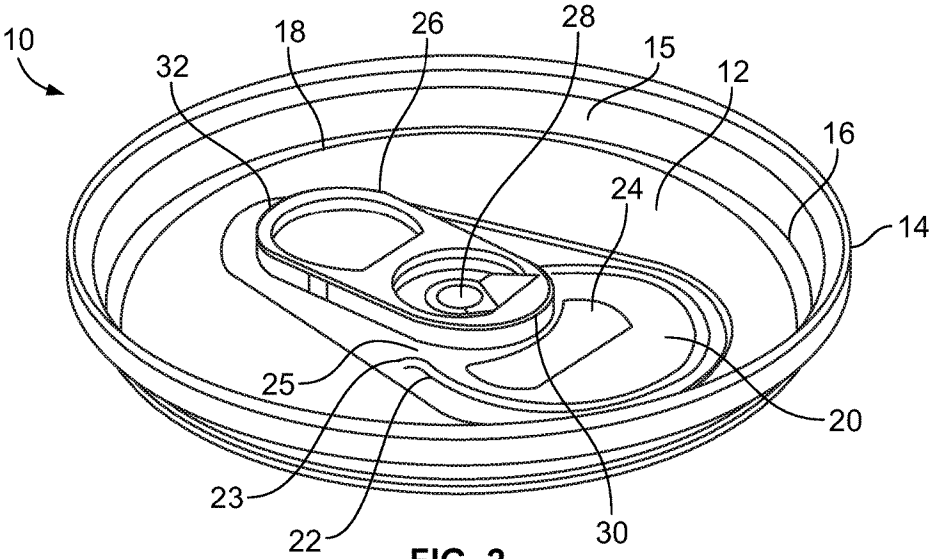
FIG. 2 is a perspective view of a reformed can end or lid of the present invention.
Figure 3:
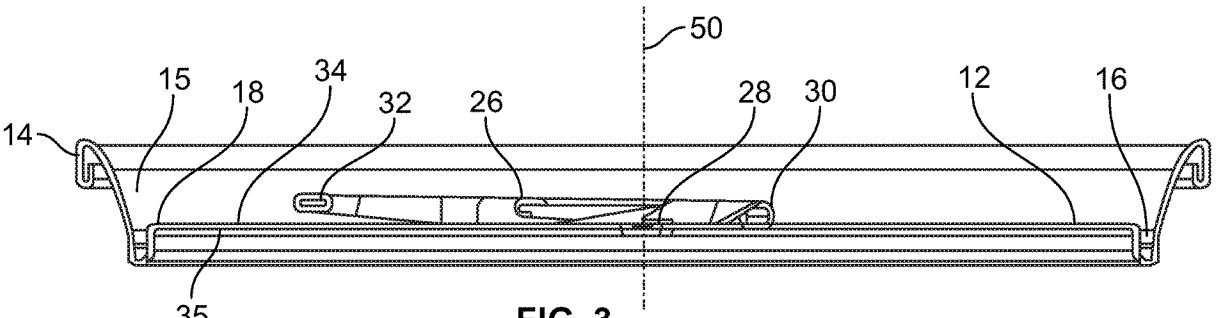
FIG. 3 is a cross-sectional view of the can end or lid of FIG. 2.
Figure 4:
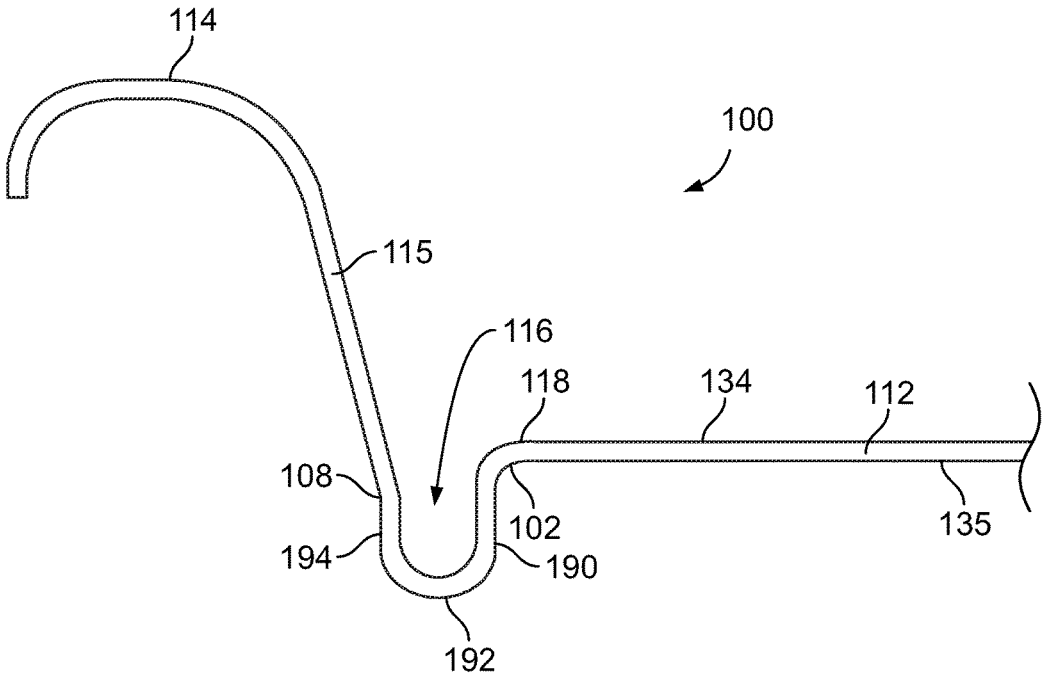
FIG. 4 is a schematic view of an unreformed can end shell prior to reforming.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to the figures, a two-piece beverage container 1 has an end closure 10 attached to a container body 11. The end closure, or can end or lid, 10 has a central panel wall 12 having a seaming curl 14 for joining the end closure 10 to the container. The container is typically a drawn and ironed metal can, usually constructed from a thin plate of aluminum or steel. End closures for such containers are also typically constructed from a cutedge of a thin plate of aluminum or steel, formed into blank end, and manufactured into a finished end by a process often referred to as end conversion. In the embodiments shown in the figures, the central panel 12 is joined to a container by a seaming curl 14 which is joined to a mating curl of the container 11. The seaming curl 14 of the end closure 10 is integral with the central panel 12 by a downwardly extending wall 15 and a strengthening member 16, typically either a countersink or a triple fold, which is joined to the panel outer edge 18 of the central panel 12. This type of means for joining the central panel 12 to a container 11 is presently the typical means for joining used in the industry, and the structure described above is formed in the process of forming the blank end from a cutedge of metal plate, prior to the end conversion process. However, other means for joining the central panel 12 to a container 11 may be employed with the present invention.

The steps of manufacturing the end begin with blanking the cutedge, typically a round or non-round cutedge of thin metal plate. Examples of non-round cutedge blanks include elliptical cutedges, convoluted cut edges, and harmonic cut edges. A convoluted cutedge may be described as generally having three distinct diameters, each diameter being 45° relative to the others. The cutedge is then formed into a blank end by forming the seaming curl, countersink, panel radius and the central panel.

A means for opening the can end or accessing the contents of the container is typically formed in a conversion process for this type of end closure. This process includes the following steps: forming a rivet by first forming a projecting bubble in the center of the panel and subsequently working the metal of the bubble into a button and into the more narrow projection of metal being the rivet; forming the tear panel by scoring the metal of the panel wall; forming an inner bead or panel on the tear panel; forming a deboss panel by bending the metal of the panel wall such that a central area of the panel wall is slightly lower than the remaining panel wall; staking the tab to the rivet; and other subsequent operations such as wipe-down steps to remove sharp edges of the tab, lettering on the panel wall by scoring, incising, or embossing (or debossing), and restriking the rivet island.

The central panel wall 12 is generally centered about a longitudinal axis 50 and has a displaceable tear panel 20 defined by a frangible score 22 and a non-frangible hinge segment 25. The tear panel 20 of the central panel 12 may be opened, that is the frangible score 22 may be severed and the tear panel 20 displaced at an angular orientation relative to the remaining portion of the central panel 12, while the tear panel 20 remains hinged to the central panel 12 through the hinge segment. In this opening operation, the tear panel 20 is displaced at an angular deflection. More specifically, the tear panel 20 is deflected at an angle relative to the plane of the panel 12, with the vortex of the angular displacement being the hinge segment.

The tear panel 20 is formed during the conversion process by a scoring operation and preferably has a surface area greater than 0.5 $in^2$ (3.23 $cm^2$). The tools for scoring the tear panel 20 in the central panel 12 include an upper die on a public side 34 having a scoring knife edge in the shape of the tear panel 20, and a lower die on a product side 35 to support the metal in the regions being scored. When the upper and lower dies are brought together, the metal of the panel wall 12 is scored between the dies. This results in the scoring knife edge being embedded into the metal of the panel wall 12, forming the score which appears as a wedge-shaped recess in the metal. The metal remaining below the wedge-shaped recess is the residual of the score 22. Therefore, the score 22 is formed by the scoring knife edge causing movement of metal, such that the imprint of the scoring knife edge is made in the public side 34 of the panel wall 12.

The tear panel 20 may also include an anti-fracture score 23. The anti-fracture score is generally located radially inwardly of the frangible score 22, except in the hinged region 25, and generally follows the contour of the frangible score 22. The anti-fracture score is provided to reduce residual stresses associated with the primary score line so as to prevent or minimize the occurrence of microcracks in, or premature fracture along, the frangible score line 22. Thus, a score line may include both the frangible score 22 and the anti-fracture score 23 in combination or, as will be described, solely the frangible score 22.

The tear panel 20 may further include a down panel 24. The down panel 24 forms a recessed segment between approximately 10 o'clock and 2 o'clock locations on the tear panel 20, using a clock-like orientation wherein a center of the clock-like orientation is defined by a central axis extending through a rivet 28 which is perpendicular to a transverse axis extending through a widest segment of the displaceable tear panel 20 and wherein a segment of the central axis defines a 12 o'clock to 6 o'clock distance. From the recessed segment toward the 6 o'clock position on the tear panel 20, the down panel 24 gently decreases in depth until it blends smoothly with adjacent areas of the tear panel 24 between approximately the 4 o'clock position clockwise to approximately the 8 o'clock position and remaining at least somewhat recessed from approximately the 8 o'clock position clockwise to approximately the 4 o'clock position.

The inventor is also aware of tear panels having circumferential up or convex beads and circumferential reverse, down, or concave beads.

The central panel 12 further includes a tab 26. The tab 26 has a generally elongated body with a central axis defined by a central cross section through the tab nose 30, and through a central webbing 42 and the lift end 32. Typical prior art container ends often have a tab 26 which is staked in the final steps of the conversion process by staking the area of the panel wall 12 adjacent and under the rivet island 46 at an angle, to bias the tab 26 such that the lift end 32 of the tab 26 rests close to the panel wall 12. The central panel 12 may also have a recess near the lift end 32 of the tab 26 to allow for easier finger access.

The opening of the tear panel 20 is operated by the tab 26 which is attached to the central panel 12 by the rivet 28, generally through a rivet hole. The tab 26 is attached to the central panel 12 such that the nose 30 of the tab 26 extends over a proximal portion of the tear panel 20. The lift end 32 of the tab 26 is located opposite the tab nose 30 and provides access for a user to lift the lift end 32, such as with the user's finger, to force the nose 30 against the proximal portion of the tear panel 20.

When the tab nose 30 is forced against the tear panel 20, the score 22 initially ruptures at the vent region of the score 22 of the tear panel 20. This initial rupture of the score 22 is primarily caused by the lifting force on the tab resulting in lifting of a central region of the center panel, immediately adjacent the rivet 28, which causes separation of the residual metal of the score 22. The force required to rupture the score in the vent region, typically referred to as the "pop" force, is a lower degree of force relative to the force required to propagate other regions of the score 22 by continued lifting of the lift end 32 of the tab 26. Therefore, it is preferable for the panel 12 in the area around the rivet 28 only lifts enough to assist with initial score rupture, or "pop," and remains substantially stiff and flat to provide the needed leverage for the tab 26 to propagate the scoreline of the tear panel 20. The present invention provides such optimal stiffness in the center panel, as is explained further below.

After the initial "pop", or venting of the tear panel, the user continues to lift the lift end 32 of the tab 26 which causes the tab nose 30 to be pushed downward on the tear panel 20 to continue the rupture of the score 22, as an opening force. As the opening operation is continued, the tear panel 20 is displaced downward and is rotated about the hinge region to be deflected into the container.

Referring to FIGS. 4-15, a method for reforming a can end shell 100 to produce the end member 200 described herein is disclosed. The method is used to produce a lightweight end member 200, for example from an 0.0113 inch (0.287 mm) thick aluminum stock, for attachment to a container body necked to a 209 (about 2.5 inches or 63.5 mm) open end. Presently, can ends 200 of this type are produced from 0.0115 inch (0.292 mm) thick aluminum stock. End members 200 of the present invention are generally manufactured using a multi-stage reforming method.

The inventors have discovered that reforming the can end according to the present invention in the conversion press rather than creating the final shape in the shell press leads to a more consistent shape of the can end from article to article. In other words, one of the benefits of the present invention is a more consistent product with less variability.

An end member shell 100 is produced in a shell press. The shell center panel diameter is a distance designated $D_{SCP}$ (about 2.24 inches or 59 mm) from a central axis 50. A countersink 116 of the end member shell 100 includes an inner wall 190, an annular curved segment 192, and an outer wall 194. The annular curved segment 192 has a radius of curvature $R_{SCS}$ (about 0.020 inches or 0.508 mm). A center panel 112 is a height $H_{SCP}$ (about 0.075 inches or 1.91 mm) above a lowermost portion of the countersink 116 or baseline. The inner wall 190 is joined to a shell panel radius 102 along the outer peripheral edge portion 118 of the central panel 112. The shell panel radius 102 has a radius of curvature $R_{SPR}$ (about 0.015 inches or 0.381 mm). The outer wall 194 of the countersink 116 is joined to a circumferential wall 115.

The circumferential wall 115 includes a crease or bend portion 108 creating an angle $\theta_S$ of approximately 15°, more preferably between 14.6°. The angle $\theta_S$ is directed outwardly relative of the central panel 112.

The seaming curl 114 is located at an outer perimeter of the end member shell 100 at a height $H_{SCS}$ (0.274 inches or about 6.96 mm) above the baseline.

Figure 5:
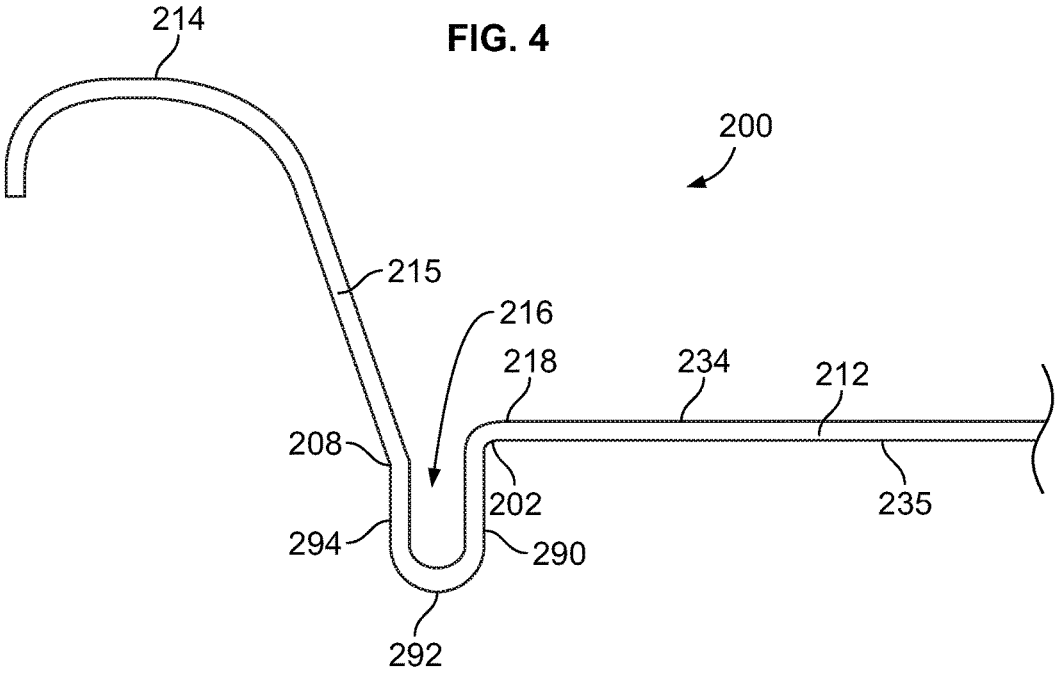
FIG. 5 is a schematic view of the reformed can end shell of FIG. 4 subsequent to reforming to arrive at a reformed can end or lid of the present invention.
Figure 6:
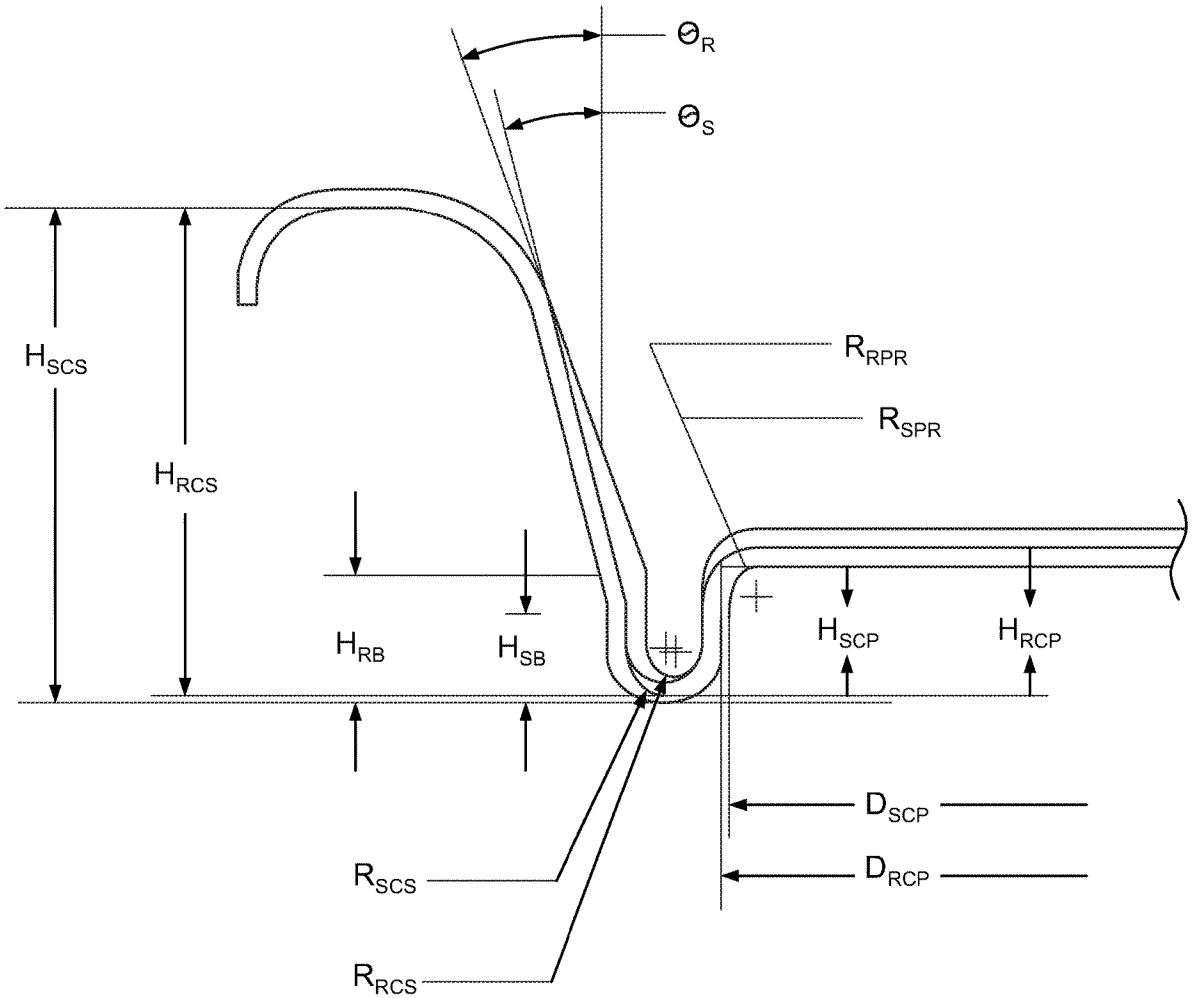
FIG. 6 is a schematic view of the reformed can end or lid of FIG. 5 superimposed on the can end shell of FIG. 4 to highlight the structural differences between the two.

The end member shell 100 undergoes a reforming operation during which one or more of the center panel 112, the shell panel radius 102, the countersink 116, and the circumferential wall 115 are reformed. FIG. 5 illustrates the shell member 100 after reforming in a conversion press to form a reformed can end 200 of the present invention. The reforming operation is intended to optimize resistance to buckle. Buckle is the loss or degradation of ability of the center panel to withstand internal pressure. FIG. 6 shows the reformed can end 200 superimposed over the can end shell 100 to highlight the structural changes brought about the reforming operation. The reformed end member 200 includes panel radius 202 along the outer peripheral portion 218 of the center panel 212. The panel radius 202 is joined to the inner wall 290 of the countersink 216.

Figure 7:
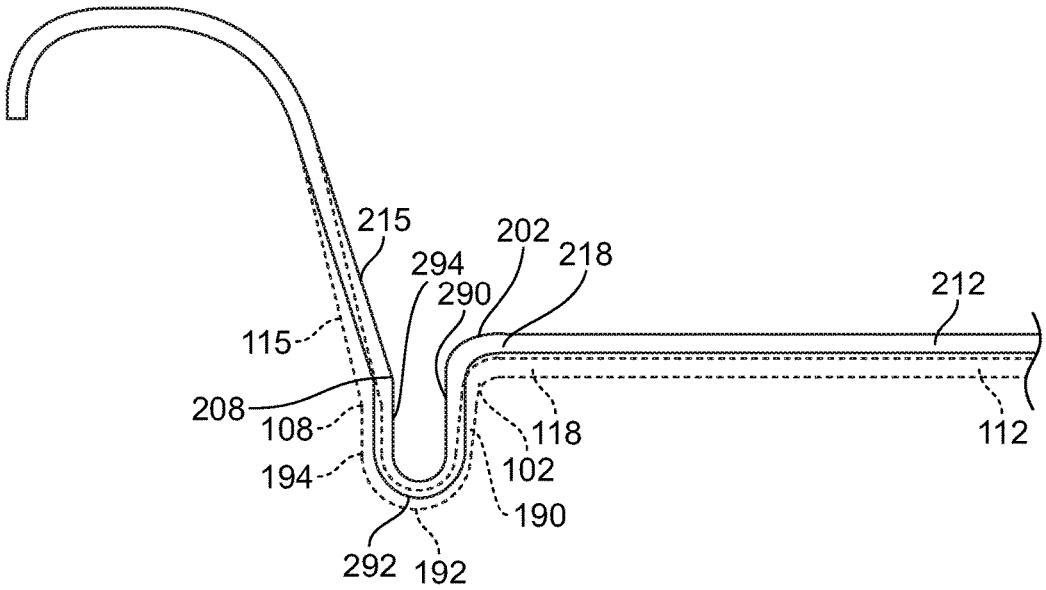
FIG. 7 is a schematic view of the reformed can end or lid of FIG. 5 superimposed on the can end shell of FIG. 4 with the can end shell shown in phantom.
Figure 8:
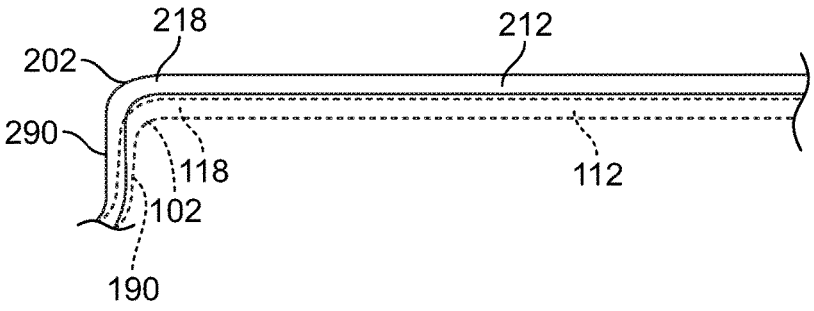
FIG. 8 is a partial schematic view showing an expansion of a center panel and a reduction in a radius of curvature of a panel radius subsequent to reforming.

As shown in FIGS. 6-8, the shell 100 is reformed to expand the diameter $D_{SCP}$ of the center panel 112, preferably while holding the overall diameter constant. Accordingly, a method of the present invention is directed to reforming an end member shell 100 comprising a central panel 112 extending radially outwardly from the longitudinal axis 50, a panel radius 102 along a peripheral edge 118 of the central panel 112, a strengthening member 116, e.g. a countersink or a triple fold, integral with the panel radius 102, a circumferential wall 115 extending upwardly from the strengthening member 116, and a curl 114 defining the outer perimeter of the end member shell 100 and integral with the circumferential wall 115. The can end shell 100 is reformed to increase a diameter of the can end shell $D_{SCP}$ to a diameter of a reformed can end $D_{RCP}$. The overall diameter of the can end shell 100 is held constant during reforming. This may be accomplished by a combination of reforming operations.

For instance, the panel radius 102 of the can end shell 100 may be reformed to decrease a radius of curvature of the can end shell $R_{SPR}$ to a reformed radius of curvature of the reformed can end $R_{RPR}$. (See FIG. 8). Further, the inner wall 190 of the can end shell 100 may be reformed to decrease its magnitude from an angle extending radially inwardly relative to the longitudinal axis 50 to a more vertical or upright orientation, preferably very nearly vertical. (See FIG. 12). Preferably, both of these techniques are used in conjunction with additional techniques illustrated in the drawings and described in detail below.

A reformed can end 200 having an expanded center panel diameter $D_{RCP}$ subsequent to reforming will have a diameter that is greater than 85% of the overall diameter of the can end 200. Typically, the diameter of a can end of the present invention has an overall diameter between 1.97 inches to 2.76 inches (50 mm to 70 mm) and the center panel has a diameter greater than 2.01 inches (51 mm). In the case of a 209 can end having an overall diameter greater than 2.48 inches (63 mm) and less than 2.81 inches (71 mm), and preferably about 2.74 inches (69.6 mm) prior to attachment to a can body 11, and 2.56 inches (65 mm) subsequent to attachment to a can body 11. The center panel diameter $D_{RCP}$ will be about 2.18 inches (55 mm) to about 2.44 inches (62 mm). Preferably, the reformed center panel diameter $D_{RCP}$ will be greater than 87% of the seamed diameter, more preferably greater than about 87.7% of the seamed diameter or about 2.248 inches (57.1 mm) expanded subsequent to reforming from a shell 100 having a shell center panel diameter $D_{SCP}$ of about 2.243 inches (57.0 mm). According to the methods of expanding the diameter, the can end 200 may exhibit a reformed panel radius 202 and/or a reformed inner wall 290, preferably both.

Figure 9:
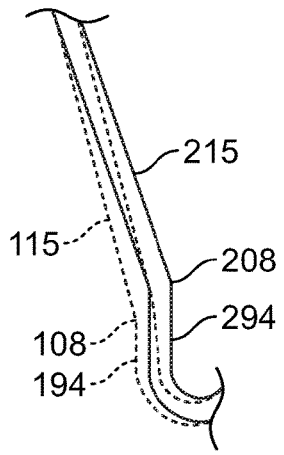
FIG. 9 is a partial schematic view showing an elevation of a bend in a circumferential wall subsequent to reforming.

As shown in FIGS. 6, 7, and 9, the shell 100 as described above is reformed such that the crease 108 is elevated to from an original height of $H_{SB}$ (about 0.049 inches or 1.24 mm) to a second, reformed height $H_{RB}$ (about 0.065 inches or 1.65 mm). Height $H_{RB}$ is greater than height $H_{SB}$ as measured from the crease 108,208 to the baseline. Accordingly, a method of the present invention requires providing an end shell 100 having a circumferential wall with a bend 108 therein located at a height $H_{SB}$ above a lowermost portion of the strengthening member 116. The shell 100 is reformed to increase the $H_{SB}$ of the bend 108 above the lowermost portion of the strengthening member 116. Thus, the reformed can end 200 has a reformed circumferential wall 215 having a reformed bend 208 located at height $H_{RB}$ above the baseline which is greater than a height $H_{SB}$ of the unreformed bend 108 above the unreformed shell baseline.

It follows that a can end 200 made according to this method has a center panel 212 extending radially outwardly from a longitudinal axis 50. A panel radius 202 is located along an outer peripheral edge 218 of the center panel 212. A frangible score 22 and a hinge portion 25 define an openable tear panel 20 in the center panel 212. A stay-on tab 26 is attached to the center panel 212 and having a nose portion 30 overlying the tear panel 20 opposite a lift end 32 of the tab 26. A wall 290 extends downwardly from the panel radius 202 to an annular bead 292 extending radially outwardly relative to the wall 290. An outer wall 294 extends upwardly relative to the annular bead 292 to an elevated bend 208 having a center of curvature below a product side 234 of the can end 200 so that the elevated bend 208 has an increased height $H_{RB}$ above a lowermost portion of the annular bead 292 subsequent to a reforming operation. A circumferential wall 215 angles upwardly from the bend 208. A curl 214 is positioned about the longitudinal axis 50 and defines an outer perimeter of the can end 200. The reformed bend preferably has a radius of curvature of about 0.014 inches to 0.015 inches (0.36 mm to 38 mm).

Figure 10:
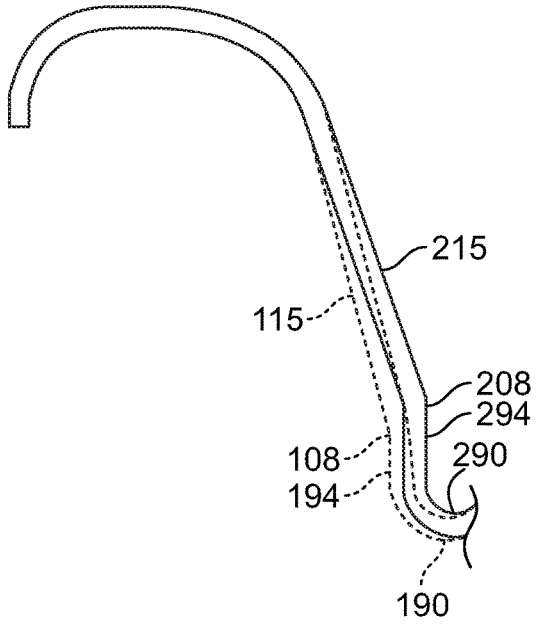
FIG. 10 is a partial schematic view showing a reduction in height of the can end or reduction of depth in a countersink subsequent to reforming.

As shown in FIGS. 6, 7, and 10, a can end shell 100 as described herein is reformed to decrease a depth of the shell countersink $H_{SCS}$ to a reformed depth $H_{RCS}$ (about 0.270 inches or 6.86 mm) of the reformed can end countersink 216. This distance is generally measured from the baseline to a uppermost portion of the product side of the curl.

Figure 11:
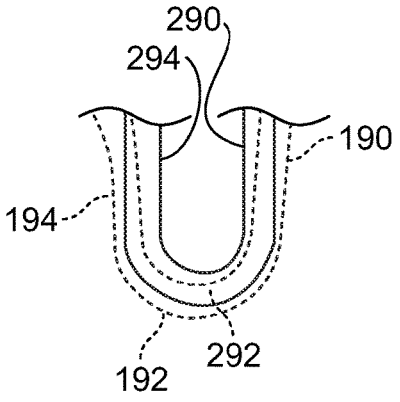
FIG. 11 is a partial schematic view showing a reduction of a radius of curvature of an annular curved segment of a countersink subsequent to reforming.

As shown in FIGS. 6, 7, and 11, a can end shell 100 as described herein is reformed to decrease a radius of curvature of the shell annular curved segment $R_{SCS}$ to a reformed radius of curvature of the reformed annular curved segment $R_{RCS}$ (about 0.015 inches or 0.38 mm). The reformed can end 200 will have a substantially vertical countersink inner wall 290, an annular curved segment 292 having a radius of curvature $R_{RCS}$, and a countersink outer wall 294 extending upwardly to the bend 208. The countersink outer wall 294 may be substantially vertical or be angled radially outwardly relative to the longitudinal axis 50 about 1° as measured from a vertical axis.

Figure 12:
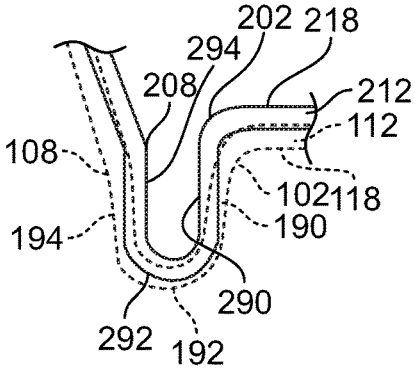
FIG. 12 is a partial schematic view showing a reforming of an inner wall of a countersink to decrease the angle of the wall bringing it to a substantially vertical orientation subsequent to reforming.

As shown in FIGS. 6, 7, and 12, a can end shell 100 as described herein is reformed to increase a height of the shell center panel $H_{SCP}$ to a reformed height of the center panel of the reformed can end $H_{RCP}$ (about 0.081 inches or 2.06 mm).

Also as shown in FIGS. 6. 7, and 12, the circumferential wall 115 of the shell 100 may be reformed to increase the wall angle $\theta_S$ creating a new circumferential wall angle $\theta_R$ greater than 12°, about 15°–25°, more preferably between 17°–22°, and most preferably about 19.8°, or any range or combination of ranges therein.

Figure 13:
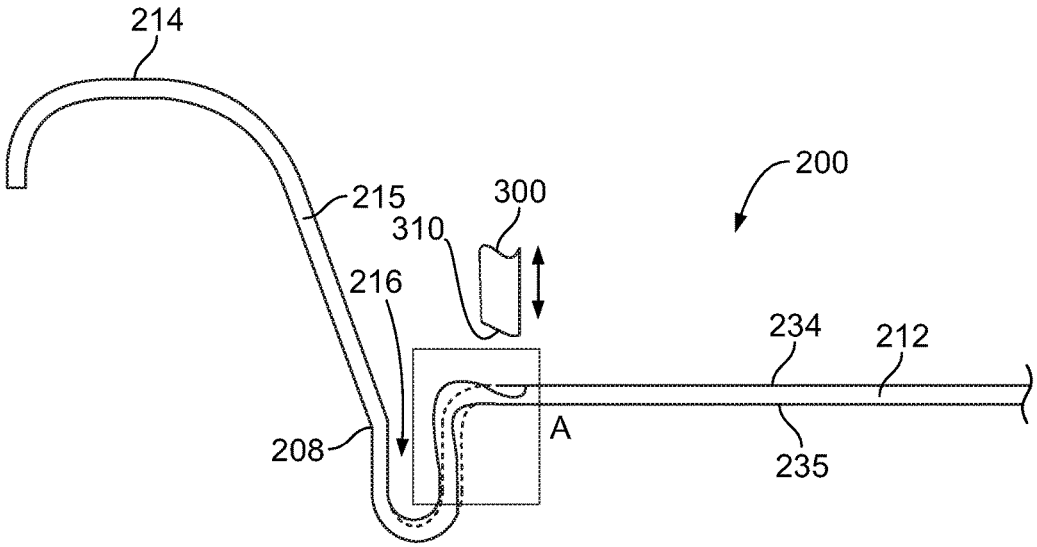
FIG. 13 is a partial schematic view showing a coining operation of the present invention.
Figure 13A:
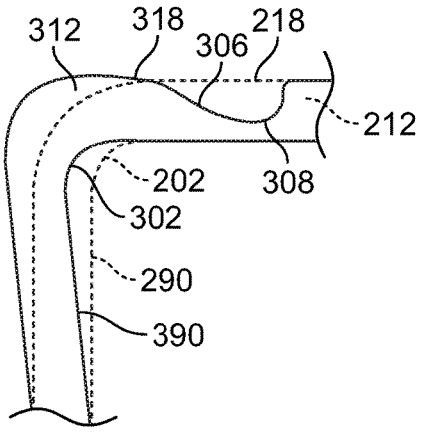
FIG. 13A is a magnified segment of FIG. 13 showing the particular geometry resulting from coining operation illustrated in FIG. 13.

As shown in FIGS. 13 and 13A, a coining operation may be utilized to increase the ability of the can end 200 to withstand buckle, i.e. improve buckle strength. Coining is a compression of material between two tools to produce a thinner work hardened segment of the can end for improved strength. In the coining operation of the present invention, an annular upper tool 300 has an annular tapered contacting surface 310 which engages a portion of the peripheral edge of the center panel and compresses the center panel against a bottom tool (not shown). The tapered surface 310 has a portion which angles upwardly and outwardly relative to the longitudinal axis. This coining operation produces a unique reformed segment 306 along the peripheral edge of the center panel. Namely, the segment is asymmetrically skewed due to the shape of the tapered surface 310. A flow of metal is urged radially outwardly wherein a thickness of the center panel in the coined area 306 is greater towards a radially outer segment of the coined area. Thus, a thickness of center panel in the coined region is at its minimum at a radially inner portion of the coined segment. The thickness of the center panel in the coined area 306 is tapered such that it gradually increases in a radially outward direction while it more abruptly increases in a radially inward direction. Stated another way, the coined segment has a thickness which increases more gradually from a material thickness minimum 308 radially outwardly as compared to moving from the material thickness minimum 308 radially inwardly. In other words, the rate at which the coined segment increases from the minimum thickness to the uncoined center panel is less when moving radially outwardly from minimum thickness than when moving radially inwardly.

The post coined end has an expanded center panel 312 created by a "mushrooming" of the metal at the peripheral edge 318 of the center panel 312. This may also cause the countersink inner wall 390 and the panel radius 302 is shift radially outwardly forming a negative angle of the inner wall 390 wherein the angle of the inner wall 190 of the shell 100 was pushed to approximately a vertical orientation and the coining operation further urges the inner wall 290 of the reformed can 200 radially outwardly such that inner wall is forced through the vertical orientation to a slightly negative angle less than 5° and greater than 0°, further contemplated at less than 3° and greater than 0°, and still further contemplated at about 1° or less and greater than 0°. These effects are shown in an exaggerated form in FIGS. 13 and 13A to illustrate the generally desired outcomes of the coining operation.

The coining operation of the previous paragraph may be reversed such that the rate of increase of the thickening in the coined segment is less when moving radially inwardly than when moving radially outwardly.

Figure 14:
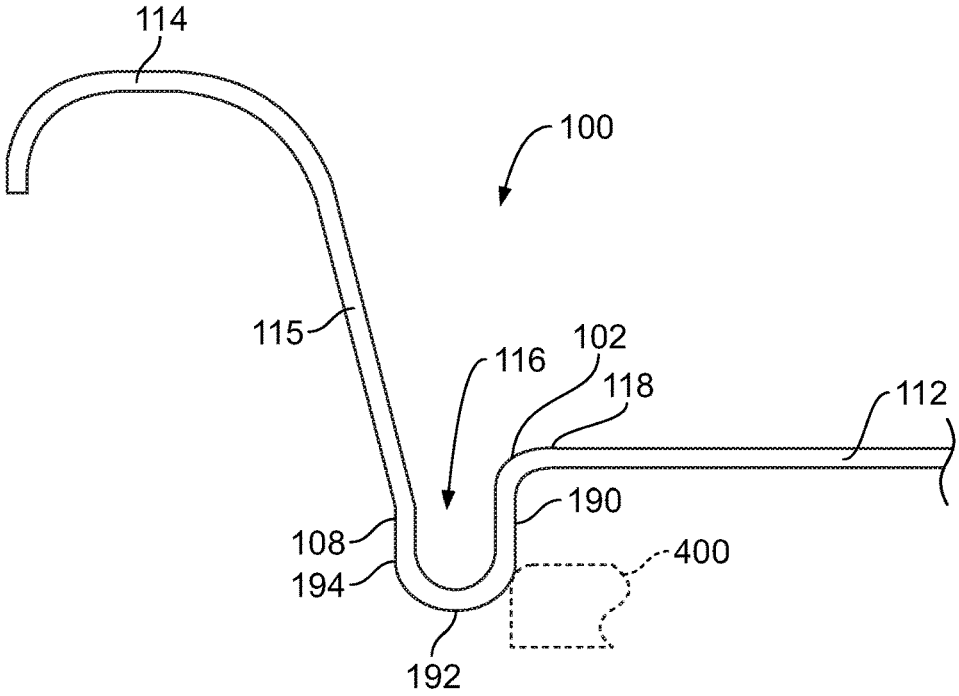
FIG. 14 is a partial schematic drawing of a tool for reforming and cold working the can end shell of the present invention.
Figure 15:
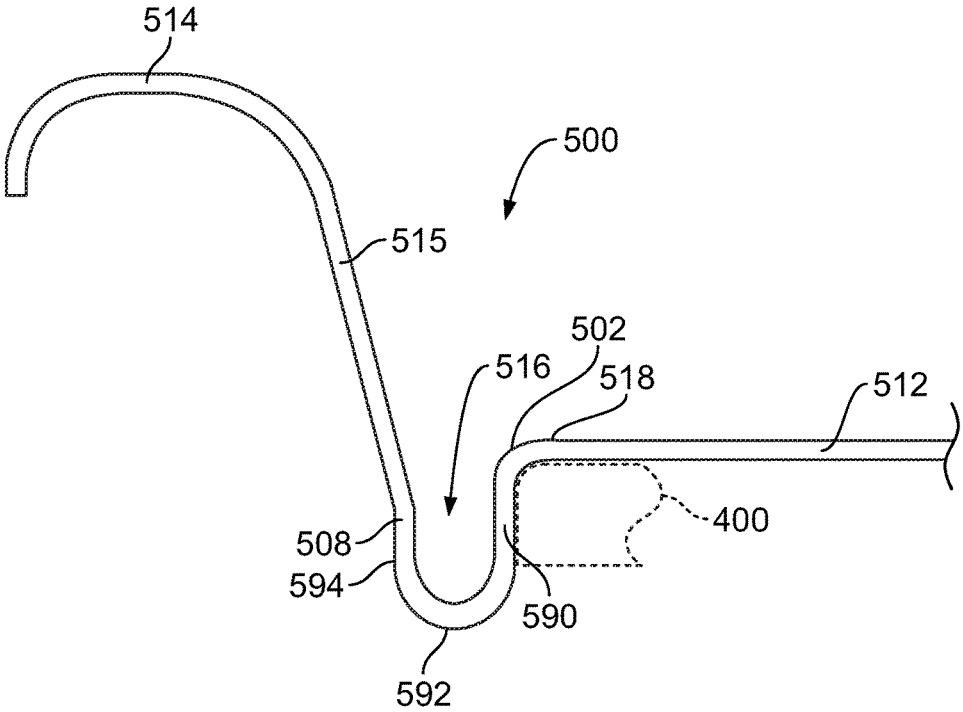
FIG. 15 is a partial schematic drawing of the tool shown in FIG. 14 in position upon completing reforming of the countersink inner wall.

Referring specifically to FIG. 14, a tool 400 for reshaping the inner wall 190 of the countersink 116 is shown at the point of contact with a lowermost portion of the inner wall 190. The tool 400 is generally annular such that it engages the inner wall continuously throughout the annular shape of the inner wall 190. The tool 400 cold works the metal in the can end shell 100 to bring the inner wall 190 more vertical, reduce the radius of curvature $R_{SPR}$ of the panel radius 102, and increase the height of the center panel $H_{SCP}$ as described above. The reforming of the inner wall 190, the panel radius 102 and the center panel 112 also results in an expansion of the center panel 112 as described above. Additionally, the inventors believe that the cold work administered to the metal during the reforming improves the strength and performance of the reformed end 200, especially in its resistance to buckle. The reformed can end 500 is illustrated in FIG. 15.

The reformed can end 500 differs from the reformed can end 200 of the previous example in that the bend 508 is not elevated during the reforming process. It should be understood, however, that the bend could be elevated according to the teachings set forth herein. The reformed can end 500 has a curl 514 defining an outer perimeter of the can end 500. A circumferential wall 515 extends downwardly and radially inwardly from the curl 514 to the bend 508. A countersink 516 has an outer wall 594 connected to the bend 508 and extending downwardly to an annular curved portion 592. The annular curved portion 592 is connected to a reformed, substantially vertical wall 590 which is connected to a reformed panel radius 502 at a peripheral edge 518 of a center panel 512. The panel radius has a smaller or tighter radius of curvature than the panel radius 102 of the unreformed shell 100.

Several separate methods for improving the strength of a can end shell 100 by reforming in a conversion press have been described. The inventors contemplate that the methods of FIGS. 4-15 can be combined to produce a reformed can end as shown in FIG. 5 having all of the characteristics and structural detail created by the separate methods described herein.

The terms "first," "second," "upper," "lower," "top," "bottom," etc. are used for illustrative purposes relative to other elements only and are not intended to limit the embodiments in any way. The term "plurality" as used herein is intended to indicate any number greater than one, either disjunctively or conjunctively as necessary, up to an infinite number. The terms "joined," "attached," and "connected" as used herein are intended to put or bring two elements together so as to form a unit, and any number of elements, devices, fasteners, etc. may be provided between the joined or connected elements unless otherwise specified by the use of the term "directly" and/or supported by the drawings.

While the specific embodiments have been illustrated and described, numerous modifications come to mind without significantly departing from the spirit of the invention, and the scope of protection is only limited by the scope of the accompanying Claims.

What is claimed is:

1. A can end for a two-piece beverage container, the can end comprising:

a curl positioned about a longitudinal axis and defining an outer perimeter of the can end having a diameter at least about 50 mm and less than about 70 mm;

a circumferential wall angled downwardly and radially inwardly relative to a radially inner portion the curl wherein an angle of the circumferential wall is greater than about 10°;

a countersink extending downwardly and radially inwardly relative to the circumferential wall;

a center panel extending radially outwardly from the longitudinal axis towards the countersink having a diameter greater than 87.7% of the overall diameter of the can end;

a panel radius joining the center panel with the countersink;

a frangible score and a hinge portion defining an openable tear panel in the center panel; and a stay-on tab attached to the center panel having a nose portion overlying the tear panel opposite a lift end of the tab.

2. The can end of claim 1 further comprising:

a bend joining the circumferential wall with the countersink having a center of curvature located below a product side of the can end.

3. The can end of claim 2 wherein an uppermost portion of the panel radius has a height as measured from a lowermost portion of the can end greater than a height of the bend.

4. The can end of claim 3 wherein the overall diameter greater of the can end is greater than about 65 mm and the center panel has a diameter greater than about 57 mm.

5. The can end of claim 4 wherein the countersink is generally U-shaped having an inner wall joined to an outer wall by an annular curved portion wherein the inner wall is substantially vertical.

6. The can end of claim 5 further comprising:

a coined segment of a compressed metal in the center panel having a portion of a minimum thickness wherein a rate at which a compressed metal thickness increases from the minimum thickness to a thickness of an uncoined center panel portion is less when moving radially outwardly from minimum thickness than when moving radially inwardly.

7. The can end of claim 1 wherein a thickness of the center panel of the can end is about 0.287 mm.

8. The can end of claim 6 wherein a height of the center panel is about 2.06 mm.

9. The can end of claim 8 wherein a radius of curvature of an annular curved segment of the countersink is about 0.38 mm.

10. A can end for a two-piece beverage container, the can end comprising:

a curl positioned about a longitudinal axis and defining an outer perimeter of the can end;

a circumferential wall angled downwardly and radially inwardly relative to a radially inner portion of the curl;

a strengthening member extending radially inwardly relative to the circumferential wall;

a center panel extending radially outwardly from the longitudinal axis towards the strengthening member having a diameter greater than 87.7% of the overall diameter of the can end;

a frangible score and a hinge portion defining an openable tear panel in the center panel; and a stay-on tab attached to the center panel having a nose portion overlying the tear panel opposite a lift end of the tab.

11. The can end of claim 10 wherein the strengthening member is a generally U-shaped countersink having an inner wall joined to an outer wall by an annular curved portion wherein the inner wall is substantially vertical.

12. The can end of claim 11 wherein a bend is located between the circumferential wall and the outer wall of the countersink wherein the bend directs the circumferential wall upwardly and outwardly relative to the longitudinal axis.

13. The can end of claim 12 wherein the annular curved segment of the countersink has been reformed to decrease the radius of curvature thereof.

14. The can end of claim 12 wherein the circumferential wall and the outer wall of the countersink have been reformed to increase a height of the bend above a lowermost portion of the countersink.

15. The can end of claim 12 wherein a depth of the countersink as measured from an uppermost portion of the curl to a lowermost portion of the countersink has been decreased in a reforming operation.

16. The can end of claim 12 wherein a radius of curvature of the panel radius has been decreased during a reforming operation.

17. The can end of claim 16 wherein an angle of the circumferential wall has been increased during a reforming operation.

18. A can end for a two-piece beverage container, the can end comprising:

a curl positioned about a longitudinal axis and defining an outer perimeter of the can end;

a circumferential wall angled downwardly and radially inwardly relative to a radially inner portion the curl;

a countersink extending downwardly and radially inwardly relative to the circumferential wall having an outer wall joined to an inner wall by an annular curved segment;

a center panel extending radially outwardly from the longitudinal axis towards the countersink;

a panel radius joining the center panel with the countersink;

a frangible score and a hinge portion defining an openable tear panel in the center panel;

a stay-on tab attached to the center panel having a nose portion overlying the tear panel opposite a lift end of the tab; and wherein the inner wall of the countersink and the panel radius comprise a zone of reformed cold worked metal, wherein the inner wall is substantially vertical.

19. The can end for a two-piece beverage container of claim 18 further comprising:

a bend located between the circumferential wall and the outer wall of the countersink, the bend located at a height above the annular curved segment of the countersink which is less than a height of the panel radius.

* * * * *